US008843011B2

(12) United States Patent
Iritani

(10) Patent No.: US 8,843,011 B2
(45) Date of Patent: Sep. 23, 2014

(54) IMAGE-FORMING APPARATUS AND METHOD FOR CONTROLLING IMAGE-FORMING APPARATUS

(71) Applicant: Kyocera Document Solutions Inc., Osaka (JP)

(72) Inventor: Kazunobu Iritani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 55 days.

(21) Appl. No.: 13/751,720

(22) Filed: Jan. 28, 2013

(65) Prior Publication Data

US 2013/0195490 A1 Aug. 1, 2013

(30) Foreign Application Priority Data

Jan. 31, 2012 (JP) ..... 2012-018015

(51) Int. Cl.
*G03G 15/20* (2006.01)
*G03G 15/00* (2006.01)
*G03G 13/20* (2006.01)

(52) U.S. Cl.
CPC ..... *G03G 13/20* (2013.01); *G03G 15/205* (2013.01); *G03G 15/80* (2013.01)
USPC ..... 399/67; 399/88

(58) Field of Classification Search
USPC ..... 399/67, 88
See application file for complete search history.

(56) References Cited

U.S. PATENT DOCUMENTS

| | | | | |
|---|---|---|---|---|
| 6,317,571 | B1 * | 11/2001 | Adams | 399/67 |
| 7,006,773 | B2 * | 2/2006 | Mizuno | 399/88 X |
| 7,257,341 | B2 * | 8/2007 | Hanamoto et al. | 399/67 |
| 7,289,745 | B2 * | 10/2007 | Nara et al. | 399/88 |
| 2005/0169655 | A1 | 8/2005 | Koyama et al. | |

FOREIGN PATENT DOCUMENTS

JP 2005-221674 A 8/2005

* cited by examiner

*Primary Examiner* — Sandra Brase
(74) *Attorney, Agent, or Firm* — NDQ & M Watchstone LLP

(57) ABSTRACT

An image-forming apparatus includes: a fixing unit; a load; a power source circuit section; a fixation electrical current detecting body; a total electrical current detecting body; a storage unit; and a fixation control unit. The fixing unit fixes a toner image using a heat generator. The power source circuit section supplies electric power to the load. The storage unit stores electrical current change amount data establishing an amount of change in the magnitude of the total electrical current relative to an amount of change in a phase for each value of the power factor of the fixing unit. The fixation control unit finds the power factor of the fixing unit, and alters the phase at which the heat generator starts to be energized on the basis of the power factor thus found and the electrical current change amount data, so that the total electrical current value approaches a target value.

14 Claims, 10 Drawing Sheets

FIG.7

| PROCESSING | POWER FACTOR | PHASE CHANGE AMOUNT | TOTAL ELECTRICAL CURRENT CHANGE AMOUNT (A) |
|---|---|---|---|
| WARM-UP STATE | X11 | 1% | Y11 |
| | | ⋮ | ⋮ |
| | | 100% | Y12 |
| | ⋮ | | |
| | X12 | 1% | Y13 |
| | | ⋮ | ⋮ |
| | | 100% | Y14 |
| DURING COPY JOB EXECUTION | X13 | 1% | Y15 |
| | | ⋮ | ⋮ |
| | | 100% | Y16 |
| | ⋮ | | |
| | X14 | 1% | Y17 |
| | | ⋮ | ⋮ |
| | | 100% | Y18 |
| ⋮ | | | |
| DURING PRINTER JOB EXECUTION | X17 | 1% | Y113 |
| | | ⋮ | ⋮ |
| | | 100% | Y114 |
| | ⋮ | | |
| | X18 | 1% | Y115 |
| | | ⋮ | ⋮ |
| | | 100% | Y116 |

FIG.10

| LOAD ELECTRICAL CURRENT (A) | POWER FACTOR | PHASE CHANGE AMOUNT | TOTAL ELECTRICAL CURRENT CHANGE AMOUNT (A) |
|---|---|---|---|
| Z21 | X21 | 1% | Y21 |
| | | ⋮ | ⋮ |
| | | 100% | Y22 |
| | ⋮ | | |
| | X22 | 1% | Y23 |
| | | ⋮ | ⋮ |
| | | 100% | Y24 |
| Z22 | X23 | 1% | Y25 |
| | | ⋮ | ⋮ |
| | | 100% | Y26 |
| | ⋮ | | |
| | X24 | 1% | Y27 |
| | | ⋮ | ⋮ |
| | | 100% | Y28 |
| ⋮ | | | |
| Z23 | X25 | 1% | Y29 |
| | | ⋮ | ⋮ |
| | | 100% | Y210 |
| | ⋮ | | |
| | X26 | 1% | Y115 |
| | | ⋮ | ⋮ |
| | | 100% | Y116 |

IMAGE-FORMING APPARATUS AND METHOD FOR CONTROLLING IMAGE-FORMING APPARATUS

This application is based upon and claims the benefit of priority from the corresponding Japanese Patent Application No. 2012-018015 filed Jan. 31, 2012, the entire contents of which are incorporated herein by reference.

BACKGROUND

The present disclosure relates to an image-forming apparatus comprising a load and a fixing unit for fixing an image.

A fixing unit including a heater is provided to an image-forming apparatus (multifunction peripheral, printer, copier, facsimile apparatus, or the like) of an electrophotography format, in order to heat a toner image. The heater warms a fixing member (for example, a roller or belt) for coming into contact with paper to perform fixing. A shorter period of time for warming the fixing member correlates to less of a wait time for the user from when a main power source is turned on, when a return from a power-saving mode takes place, or the like until the start of printing. In view whereof, there is known an image-forming apparatus to which the supply of electric power from a portion for storing electric power is enabled, in addition to a commercial power source, in order to ensure that electric power will be inputted to the heater.

More specifically, there is known an image formation which is provided with fixing means for fixing a toner image onto a transfer material, the fixing means enclosing a heat generator for using electric power supplied from a commercial power source to generate heat, and which has: a power-storing means capable of supplying electric power to a load other than the heat generator; a temperature-detecting means for detecting the temperature of the fixing means; and a controlling means for controlling the electric power being supplied to the fixing means from the commercial power source, in accordance with a temperature detection result. This configuration is an attempt to make effective use of the upper-limit electrical current (electric power) of the commercial power source to achieve on-demand fixing in which the temperature rises promptly.

Firstly, due to factors such as the acceptable electrical current of an outlet, there are limitations (a limiting value, an upper limit value) to the magnitude of electrical current that can flow to the image-forming apparatus or the outlet in the use of the commercial power source. As such, when the image-forming apparatus is being used, it is necessary to prevent the electrical current flowing to the image-forming apparatus (the sum of the electrical current flowing to the load and the electrical current flowing to the fixing unit=the total electrical current) from exceeding a limiting value. Though the limiting values vary from country to country, the maximum value of electrical current that can flow to one outlet in the case of a household, business office, or the like is often up to about 15 A to 20 A in the U.S.A. and Japan. Thus, in some cases, there has been a desire to keep the total electrical current of the image-forming apparatus at a target value (for example, the limiting value) serving as a certain limit.

In addition to the heater of the fixing unit, however, the image-forming apparatus is also provided with other electrical loads (hereinafter, simply referred to as a "load") such as a CPU for control, a memory for storing data, and a motor for rotating a variety of rotating bodies for conveying paper and the like. Often, for example, these loads are driven by direct current, and the magnitude of the drive voltage is established in advance. In view whereof, one or a plurality of power source circuit section(s) (for example, a converter) for carrying out rectification and/or stepping up/down the voltage to generate the voltage needed is/are ordinarily provided to the image-forming apparatus, in order for electric power to be supplied to each of the loads at an appropriate voltage.

In order to rapidly warm the fixing member without giving rise to a defect in the operation of the image-forming apparatus, preferably, electric power is inputted (an electrical current is made to flow) to the heater so that the total electrical current of the image-forming apparatus reaches a target value (limiting value) while adequate electric power is also being supplied to the loads, such as to the CPU. In other words, the output of the heater can be made to be a maximum output, within an acceptable range, when an electrical current obtained by subtracting the electrical current to the loads such as to the CPU from the target value of the total electrical current of the image-forming apparatus is made to flow to the heater.

In the image-forming apparatus, sometimes, alternating-current electric power based on the commercial power source is supplied to the heater while a phase control is being carried out. For example, within one period of the alternating-current voltage (a sine wave) of the commercial power source, a phase at which the heater is energized is sometimes altered to control the electrical current flowing (the electric power being inputted) to the heater of the fixing unit. In the phase control of such description, when the electrical current is increased, the phase difference between the alternating-current voltage waveform and the point in time where electric power distribution to the heater is turned on is reduced in size (the distribution of electric power to the heater is turned out at a timing that is earlier from the zero-crossing). When the electrical current is reduced, however, the phase difference between the alternating-current voltage waveform and the point in time where electric power distribution to the heater is turned on is increased in size (the timing for turning electric power distribution to the heater on after the zero-crossing is delayed). Also, generally, the power factor in the fixing unit becomes larger as the phase difference becomes smaller (for example, the power factor is 1 when the phase difference is zero). However, the power factor in the fixing unit becomes poorer as the phase difference becomes larger.

The total electrical current of the image-forming apparatus is also influenced by the result of combining the power factor of the power source circuit section (a power factor of, for example, about 0.6) and the power factor of the fixing unit. The electric power consumed by the heater mounted onto the fixing unit of the image-feinting apparatus is 1,000 watts or more. The electric power consumed by the heater is thus ordinarily greater than the electric power consumed by the load. For this reason, the total electrical current of the image-forming apparatus is dramatically influenced by changes in the power factor of the fixing unit. The power factor of the power source circuit section, too, changes sometimes depending on the output state (the magnitude of output).

For this reason, the amount of change in the total electrical current when the phase of electric power distribution to the heater is altered in an amount of the same magnitude varies depending on the state of the fixing unit prior to the change, and the like (the magnitude of the power factor of the fixing unit prior to the change, the magnitude of the power factor of the power source circuit section, and the like). In other words, the ratio of the amount of change in the total electrical current of the image-forming apparatus relative to the amount of change in the phase is not constant, and depends on the state of the image-forming apparatus.

Herein, conventionally, the total electrical current flowing to the image-forming apparatus after the phase has been altered is sometimes measured and a control for correcting the phase (feedback control) is carried out, from the standpoint of keeping the total electrical current of the image-forming apparatus at the limiting value (target value). However, the feedback control has conventionally been carried out without giving consideration to the change in the power factor of the fixing unit associated with the change in phase. In some cases, though, the amount of change in the total electrical current misses the intended amount of change even when the phase is altered, due to the influence of the change in the power factor of the fixing unit. For this reason, processing for altering the phase (phase correction processing) is repeated many times until the total electrical current of the image-forming apparatus matches the target value, and a problem emerges in that in some cases time is needed until the total electrical current can be matched to the target value. Further, because the amount of change in the total electrical value misses the intended amount of change, the target value is sometimes deliberately set to a value considerably lower than the limiting value, in order to endow a margin so as not to exceed the limiting value.

In the above-described image-forming apparatus known in the art, an attempt is made to use the power-storing means to ensure the electric power being inputted to the heater. Consideration is not given, however, to the change in the power factor of the fixing unit in the image-forming apparatus known in the art. As such, the problem where time is needed until the total electrical current of the image-forming apparatus can be matched to the target value cannot be resolved. Moreover, the total electrical current of the image-forming apparatus could exceed the limiting value in the above-described image-forming apparatus known in the art.

SUMMARY

In order to resolve the foregoing problems, an image-forming apparatus according to a first aspect of the present disclosure includes: a fixing unit; a load; a power source circuit section; a fixation electrical current detecting body; a total electrical current detecting body; a storage unit; and a fixation control unit. The fixing unit fixes a toner image to the paper using a heat generator for generating heat upon receiving electric power that is supplied to the image-forming apparatus. The load is used in the execution of a job. The power source circuit section generates a voltage for the load and supplies electric power to the load, on the basis of the electric power being supplied to the image-forming apparatus. The fixation electrical current detecting body is adapted for detecting the magnitude of a fixation electrical current, which is an electrical current that flows to the fixing unit. The total electrical current detecting body is adapted for detecting the magnitude of the total electrical current of the image-forming apparatus, the total electrical current being the sum of the electrical current that flows to the fixing unit and an electrical current that flows through the load. The storage unit stores electrical current change amount data establishing an amount of change in the magnitude of the total electrical current relative to an amount of change in a phase at which the heat generator starts to be energized, for each value of the power factor of the fixing unit. The fixation control unit recognizes the magnitude of the fixation electrical current on the basis of the output of the fixation electrical current detecting body and finds the power factor of the fixing unit, recognizes the magnitude of the total electrical current on the basis of the output of the total electrical current detecting body, and controls the drive circuit and alters the phase at which the heat generator starts to be energized on the basis of a value indicative of the power factor thus found and the electrical current change amount data, so that the total electrical current approaches a target value.

Further features and advantages of the present disclosure will become apparent from the description of embodiments given below.

BRIEF DESCRIPTION OF THE DRAWINGS

FIG. 7 is a descriptive diagram illustrating one example of electrical current change amount data as in the first embodiment;

FIG. 10 is a descriptive diagram illustrating one example of electrical charge change amount data as in the second embodiment.

DETAILED DESCRIPTION

Provided below is a description of embodiments of the present disclosure, on the basis of FIGS. 1 to 10. This description relates to an example in which a multifunction peripheral 100 serves as the image-forming apparatus. Firstly, the first embodiment shall be described with reference to FIGS. 1 to 8. The second embodiment shall be described next, with reference to FIGS. 9 and 10. However, the various elements set forth in the present embodiments, such as the configurations and arrangements thereof, are no more than mere examples of description, which do not limit the scope of the disclosure.

(Summary of the Multifunction Peripheral 100)

Figure 1:
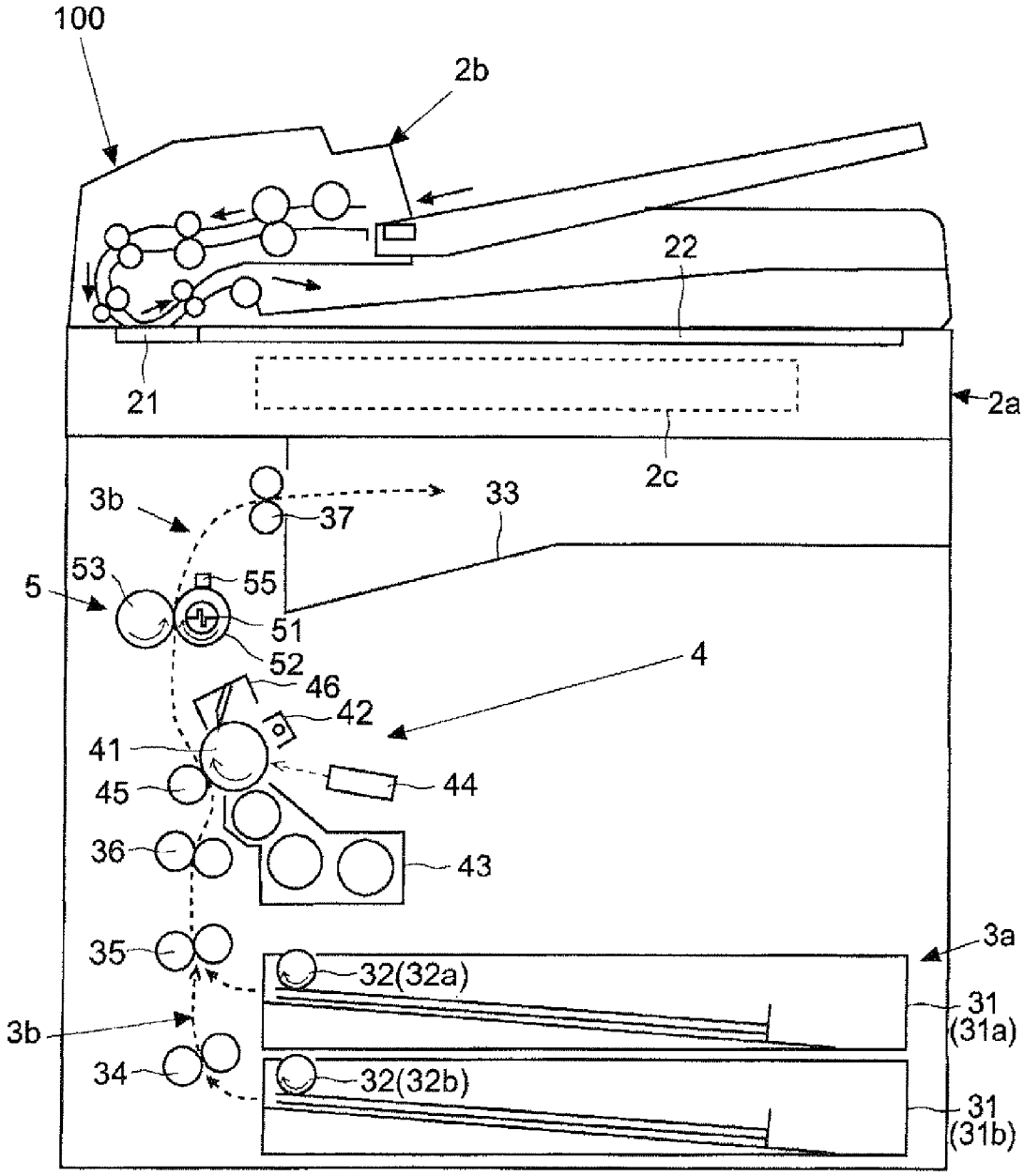
FIG. 1 is a schematic front cross-sectional view illustrating the schematic structure of a multifunction peripheral.

First, a multifunction peripheral 100 as in the first embodiment shall be described, on the basis of FIG. 1. FIG. 1 is a schematic front cross-sectional view illustrating the schematic structure of the multifunction peripheral 100.

As illustrated in FIG. 1, the multifunction peripheral 100 has at an upper part an image read unit 2*a* and, thereabove, a document conveyor unit 2*b*. An operation panel 2*c*, as illustrated by the dashed line, is also provided to an upper front part of the multifunction peripheral 100. The multifunction peripheral 100 also includes, internally, a paper feed unit 3*a*, a conveyor unit 3*b*, an image formation unit 4, and a fixing unit 5.

First, documents of a variety of types and a variety of sizes intended to be copied by a user are placed on the document conveyor unit 2*b*. when a copy or scan job is started by being inputted to the operation panel 2*c* for settings such as copy or transmission image data, the document conveyor unit 2*b* conveys the document one sheet of paper at a time toward a contact glass 21 for feed reading (a read position) provided to the image read unit 2*a*.

The interior of the image read unit 2*a* includes a light exposure lamp, a reflecting plate, a mirror, a lens, an image sensor (not shown), and the like. The image read unit 2*a* optically reads a document passing through the contact glass 21 for feed reading or a document placed on a contact glass 22 for placement reading (for example, a book) and generates image data for the document. The document conveyor unit 2*b* has a pivot point at the back side of the paper surface in FIG. 1 beyond the plane of the drawing in FIG. 1 relative to the viewer, and can be opened and closed.

The paper feed unit 3*a* supplies paper to be used in printing. The paper feed unit 3*a* includes cassettes 31 (in FIG. 1, the upper one is assigned the reference numeral 31*a*, and the lower one is assigned the reference numeral 31*b*) in which papers, such as a variety of sizes of paper, are accommodated. The paper feed unit 3*a* also includes paper feed rollers 32 (in FIG. 1, the upper one is assigned the reference numeral 32*a*, and the lower one is assigned the reference numeral 32*b*) for issuing forth the paper one sheet at a time to the conveyor unit 3*b*.

For example, the user selects the size of paper to be used (the paper) at the operation panel 2*c* and, when a start key is pressed, the paper feed rollers 32 are driven to rotate and the paper is supplied to the conveyor unit 3*b*. The conveyor unit 3*b* conveys the paper as far as a discharge tray 33, passing by way of the image formation unit 4 and the fixing unit 5. A guide (not shown), a plurality of conveyor roller pairs 34 to 37 for conveying the paper, and the like are provided to the conveyor unit 3*b*.

The image formation unit 4 forms a toner image, and transfers the toner image onto the paper being conveyed by the conveyor unit 3*b*. More specifically, the image formation unit 4 is provided with: a photosensitive drum 41 supported so as to be able to rotate in the direction of the arrow illustrated in FIG. 1; and a charging device 42, a developing device 43, a light exposure device 44, a transfer roller 45, and a cleaning device 46, which are installed around the photosensitive drum 41.

The photosensitive drum 41 is provided substantially at the center of the image formation unit 4, and is driven to rotate in a predetermined direction. The charging device 42 charges the surface of the photosensitive drum 41 uniformly to a predetermined electrical potential. The light exposure device 44 outputs a laser light on the basis of image data read by the image read unit 2*a*, and the like, and scans to expose the photosensitive drum 41 to light. The result is that an electrostatic latent image is formed on the surface of the photosensitive drum 41. The developing device 43 supplies toner toward the electrostatic latent image. The result is that the electrostatic latent image is developed as a toner image. A nip is formed between the photosensitive drum 41 and the transfer roller 45, which is provided below and to the left of the photosensitive drum 41; when the paper passes through this nip, the toner image on the photosensitive drum 41 is transferred onto the paper. The cleaning device 46 cleans the surface of the photosensitive drum 41 after transfer.

The fixing unit 5 causes the transferred toner image to be fixed onto the paper. The fixing unit 5 is constituted primarily of a heating roller 52 having a built-in heater 51 (equivalent to a heat generator), as well as a pressure roller 53 for coming into pressed contact with the heat roller 52 to form a nip. The passage of the paper onto which the toner image has been transferred through this nip causes the toner to be fused and heated, and causes the toner image to be fixed onto the paper.

(Hardware Configuration of the Multifunction Peripheral 100)

Figure 2:
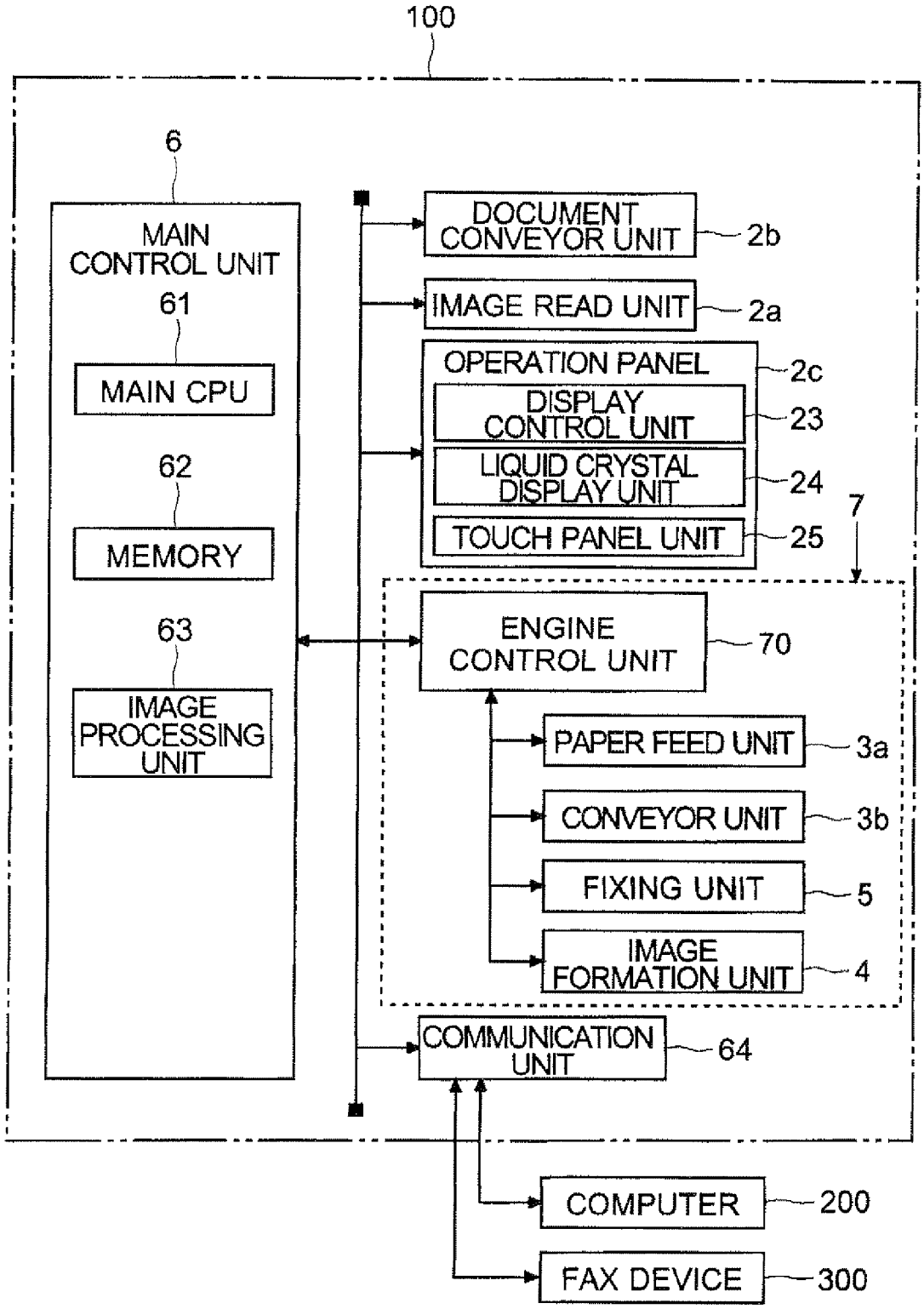
FIG. 2 is a block diagram illustrating one example of a hardware configuration for the multifunction peripheral.

Described next is one example of the hardware configuration of the multifunction peripheral 100 as in the first embodiment, on the basis of FIG. 2. FIG. 2 is a block diagram illustrating one example of the hardware configuration of the multifunction peripheral 100.

As illustrated in FIG. 2, the multifunction peripheral 100 as in the present embodiment has a main control unit 6. The main control unit 6 oversees the operation of the entire apparatus, and governs the control of each of the parts of the multifunction peripheral 100. For example, the main control unit 6 includes a main CPU 61 as a central computation processing device (see FIG. 4) and the like. The main control unit 6 also implements, for example, elements and circuits such as a memory 62, such as a ROM and/or RAM, and an image processing unit 63 (described in greater detail below).

The main control unit 6 is connected to the document conveyor unit 2*b* for conveying a document and to the image read unit 2*a* for reading a document, which both relate to the reading of documents, so as to be able to communicate therewith. The main control unit 6 gives instructions to the document conveyor unit 2*b* and the image read unit 2*a*. Receiving an instruction, the document conveyor unit 2*b* conveys a document and the image read unit 2*a* actually reads the document.

The main control unit 6 is also connected to the operation panel 2*c* so as to be able to communicate therewith. Provided to the operation panel 2*c* is, for example, a display control unit 23. The display control unit 23 controls the display of a liquid crystal display unit 24 for displaying keys for settings and the like, or detects a position (coordinates) that has been pressed on the liquid crystal display unit 24 on the basis of an output voltage of a touch panel unit 25, and recognizes the depression of a variety of hard keys (the start key and the like). Data indicative of the contents of a setting made at the operation panel 2*c* is sent to the main control unit 6. The main control unit 6 controls the multifunction peripheral 100 so as to operate as per the user's settings.

The main control unit 6 is also connected to an engine control unit 70 for actually controlling an engine unit 7 (the paper feed unit 3*a*, the conveyor unit 3*b*, the image formation unit 4, the fixing unit 5, and the like) for carrying out printing, such as for conveying paper and forming or fixing the toner image, so as to be able to communicate therewith. The main control unit 6 gives instructions on printing and paper feeding to the engine control unit 70. Receiving an instruction, the engine control unit 70 controls the engine unit 7, causes a variety of rotating bodies (the conveyor roller pairs 34 to 37, the photosensitive drum 41, and the like) to rotate, and carries out controls relating to conveying paper and forming an image.

The multifunction peripheral 100 also includes a communication unit 64 serving as a communication interface with the outside. For example, the communication unit 64 is connected to an exterior computer 200 (for example, a personal computer) so as to be able to communicate therewith over a network or cable. For this reason, the communication includes, for example, a connector, a CPU for communication control, and a chip. The multifunction peripheral 100 is also able to receive data for printing, including image data and the like, from the computer 200 or the like to carry out printing (printer functionality). It is also possible for the image data obtained through the reading at the image read unit 2*a* to be sent to the computer 200 from the multifunction peripheral 100 (seamier functionality), or for the communication unit 64 to include a modem, or a circuit, chip, or the like for converting the image data to a format that corresponds to facsimile or for expanding received data, to enable communication with a fax device 300 (fax functionality).

(Electric Power Supply System)

Figure 3:
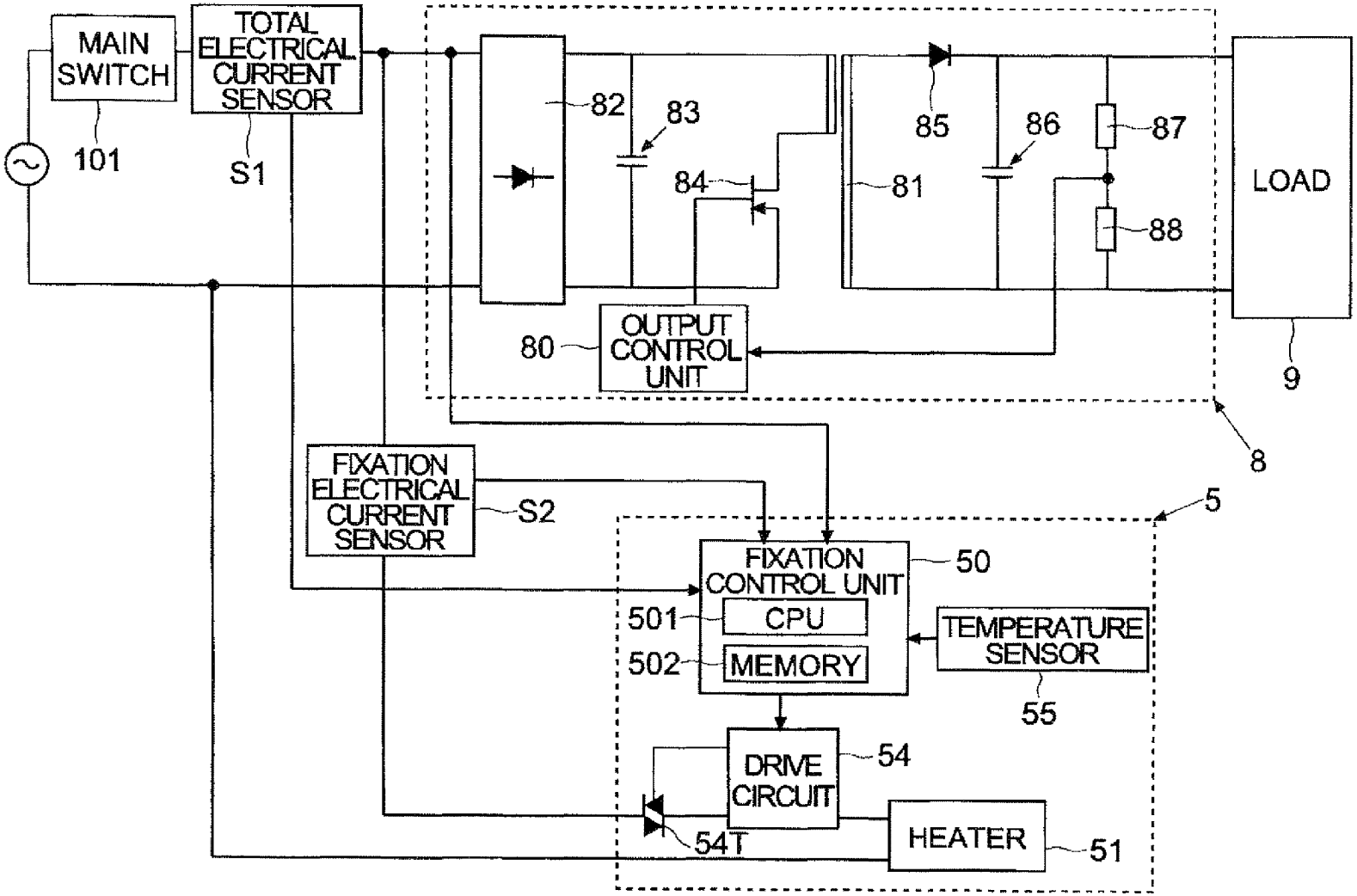
FIG. 3 is a descriptive diagram illustrating one example of a electric power supply system in a multifunction peripheral as in a first embodiment.
Figure 4:
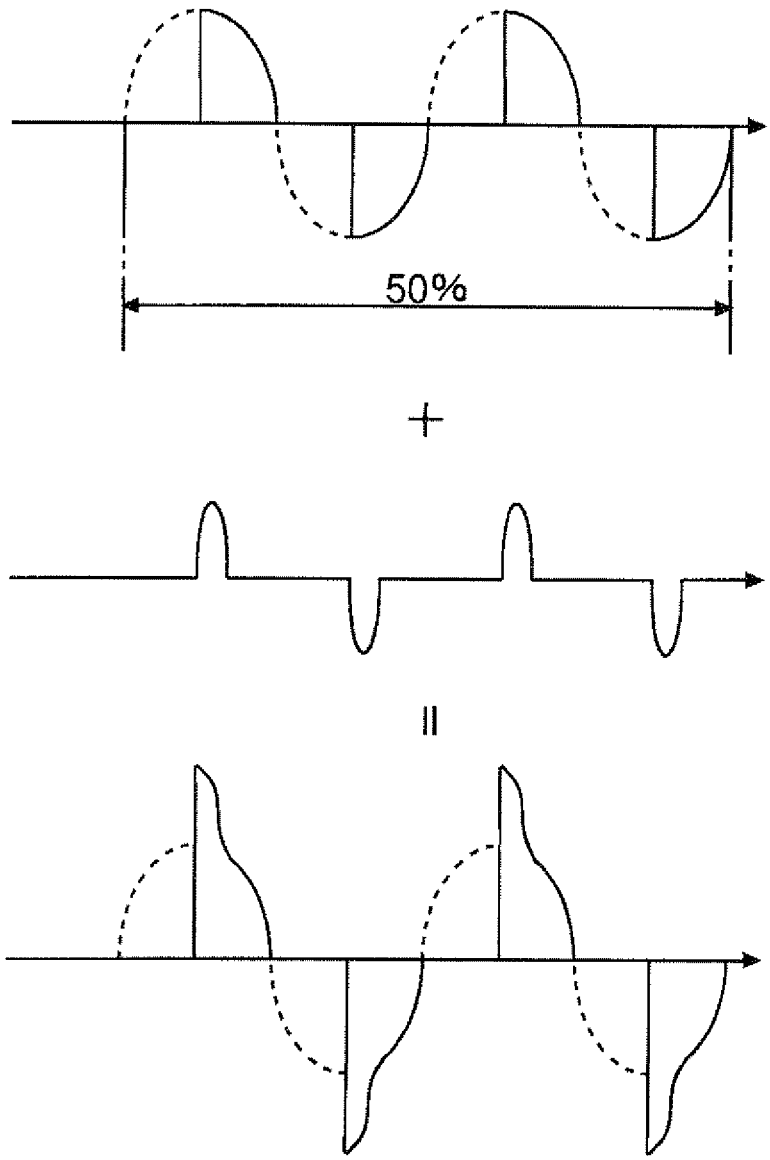
FIG. 4 is a descriptive diagram for describing phase control by a fixation control unit.

Described next is one example of the electric power supply system in the multifunction peripheral 100 as in the first embodiment, with reference to FIGS. 3 and 4. FIG. 3 is a descriptive diagram illustrating one example of the electric power supply system in the multifunction peripheral 100 as in the first embodiment. FIG. 4 is a descriptive diagram for describing phase control by a fixation control unit 50.

First, a main switch 101 for supplying (ON) or shutting off (OFF) electric power to the multifunction peripheral 100 from a commercial power source is provided to the multifunction peripheral 100. For example, the main switch 101 is provided to a side surface of the multifunction peripheral 100, or the like. Operation by the user thus makes it possible to mechanically switch between connecting to and shutting off the commercial power source (turning the main power source on or off).

Also provided to the multifunction peripheral 100 is a power source circuit section 8 for supplying electric power to an electrical load 9 other than the fixing relationship (the heater 51) provided inside the multifunction peripheral 100. With respect to heating in the fixing unit 5, the fixation control unit 50, the heater 51, a drive circuit 54, a triode for alternating current (triac) 54T, and the like are provided. The fixation control unit 50 is a portion for controlling the amount of electrical current that flows to the fixing unit 5, and the like. The fixation control unit 50, the drive circuit 54, a temperature sensor 55, and the like can be regarded as being one class of the load 9. The fixation control unit 50 includes, for example, a CPU 501 for carrying out controls, and a memory 502 (equivalent to a storage unit) for storing data and programs relating to control. A total electrical current sensor S1 (equivalent to a total electrical current detecting body) and a fixation electrical current sensor S2 (equivalent to a fixation electrical current detecting body) are provided as sensors for measuring the magnitude (effective value) of electrical current.

The present embodiment describes an example in which the fixation control unit 50 provided to the fixing unit 5 controls the electric power inputted to the heater 51 (the electrical current that flows to the heater 51). However, instead of the fixation control unit 50, the control of the electrical current that flows to the heater 51 may also be carried out by another control unit (control board), such as the engine control unit 70.

First, the power source circuit section 8 rectifies the commercial power source and generates a direct-current voltage needed to drive the load 9. For example, the power source circuit section 8 generates a voltage for driving a DC motor (for example, DC 24V). There is one type of output voltage for the power source circuit section 8 illustrated in FIG. 3, but the power source circuit section 8 may also generate and output a plurality of types of voltage, such as through the additional provision of a DC/DC converter and/or regulator.

More specifically, the power source circuit section 8 includes a transformer 81. A diode bridge 82, a capacitor 83, and a field-effect transistor (FET) 84 for carrying out rectification are provided to a primary side of the transformer 81. Provided to a secondary side of the transformer 81 are a diode 85 for evening the orientation of the electrical current, a capacitor 86 for smoothing, and a resistor 87 and a resistor 88 for detecting the output voltage of the power source circuit section 8.

An output control unit 80 for controlling the duty ratio and frequency of the switching of the FET 84 and for keeping the output voltage of the power source circuit section 8 constant at a predetermined value is also provided. For example, the output control unit 80 is a microcomputer. The voltage between the resistor 87 and the resistor 88 is inputted to the output control unit 80.

The output control unit 80 performs A/D conversion of the voltage between the resistor 87 and the resistor 88, and recognizes the voltage value. The output control unit 80 compares against the voltage value between the resistor 87 and the resistor 88 when the recognized output voltage of the power source circuit section 8 is the predetermined value. The output control unit 80 recognizes whether the present output voltage value of the power source circuit section 8 is above or below the predetermined value. The output control unit 80 also adjusts the ON/OFF duty ratio of the FET 84, and the like. The output control unit 80 thereby keeps the output voltage of the power source circuit section 8 constant at the predetermined value (a feedback control), irrespective of the magnitude of the electrical current flowing to the load 9. A voltage that is appropriate at all times can be applied to the circuits, elements, and the like included in the load 9.

The description next relates to the heating in the fixing unit 5, and the supply of electric power to the heater 51. The heater 51 illustrated in FIG. 3 is a heater 51 built into the heating roller 52 of the fixing unit 5. The heater 51 warms the heating roller 52. As a result, heat propagates also to the pressure roller 53, and the fixing unit 5 is warmed. More specifically, a halogen lamp is provided to the heater 51 in the multifunction peripheral 100. Rather than a halogen lamp, another type of energized heat generator may also be used.

Electric power supplied from the commercial power source is inputted to the heater 51. The drive circuit 54 and the triac 54T are provided in order to control the electric power being inputted to the heater 51 (the electrical current flowing to the fixing unit 5). The triac 54T is a switch for introducing and shutting off electric power to the heater 51 from the commercial power source.

The drive circuit 54 switches the triac 54T at a phase at which the heater 51 starts to be energized, as instructed from the fixation control unit 50. In other words, the fixation control unit 50 causes the drive circuit 54 to change the phase at which the triac 54T is turned on, to match the phase at which the supply of electric power to the heater 51 is to be started, relative to the alternating-current input voltage to the heater 51 (a phase control).

The description now relates to the phase control, with reference to FIG. 4. First, the uppermost graph in FIG. 4 is a graph illustrating one example of the electrical current that flows to the heater 51 of the fixing unit 5. The horizontal axes of the graphs in FIG. 4 illustrate time, and the vertical axes illustrate the amplitude (magnitude) of the electrical current.

The uppermost graph in FIG. 4 illustrates one example of an electrical current waveform that flows to the heater 51 when using a timing (phase) at which the heater 51 starts to be energized such that 50% operating duty is reached. In such a case, the fixation control unit 50 causes the drive circuit 54 to turn on the triac 54T at the points in time in one period where the phase is 90° and 270°. The voltage of the commercial power source is inputted to the fixation control unit 50, and the fixation control unit 50 monitors the voltage waveform of the commercial power source. The fixation control unit 50 also turns on the triac 54*t* at a point in time where 50% of the half-period has elapsed from the zero-crossing. In other words, using the half-period of the voltage waveform of the commercial power source as a reference, at a half-period of 1, the fixation control unit 50 turns on the triac 54T at a point in time where a length of time commensurate with the OFF duty has elapsed from the zero-crossing. Because the electric power from the commercial power source is inputted to the heater 51, a sinusoidal electrical current flows to the heater in accordance with the sinusoidal input voltage when the voltage applied to the heater 51 and the phase difference for turning on the triac 54 are zero.

The middle graph in FIG. 4 illustrates one example of the electrical current that flows to an alternating-current side of the diode bridge 82 for carrying out rectification when a predetermined electrical current flows to the load 9. As illustrated in the middle graph in FIG. 4, a choke-input electrical current flows because of the configuration of the power source circuit section 8. For this reason, in the present embodiment, for example, the waveform of the total electrical current of the multifunction peripheral 100 (the electrical current passing through the total electrical current sensor S1) is as per the bottommost graph illustrated in FIG. 4.

The total electrical current sensor S1 is a sensor for measuring the magnitude of the sum of the electrical current on the alternating-current side flowing in accordance with the electrical current consumed by the load 9, and the electrical current flowing through the fixing unit 5. In other words, the total electrical current sensor S1 is a sensor for measuring the magnitude of the total electrical current of the image-forming apparatus. The total electrical current sensor S1 is used to measure the effective value of the total electrical current of the image-forming apparatus. The output of the total electrical current sensor S1 is inputted to the fixation control unit 50. The fixation control unit 50 then recognizes the magnitude of the total electrical current of the image-forming apparatus (the sum of the electrical current flowing to the load 9 and the electrical current flowing to the fixing unit 5), on the basis of the output of the total electrical current sensor S1.

The fixation electrical current sensor S2 is a sensor for measuring the magnitude of the electrical current flowing through the fixing unit 5 (the heater 51). The output of the fixation electrical current sensor S2, too, is inputted to the fixation control unit 50. The fixation control unit 50 recognizes the magnitude (effective value) of the electrical current flowing to the fixing unit 5 (the heater 51) on the basis of the output of the fixation electrical current sensor S2.

As illustrated in FIGS. 1 and 3, the temperature sensor 55 is provided to the fixing unit 5. The temperature sensor 55 is a sensor for detecting the temperature of the heating roller 52. For example, the temperature sensor 55 includes a thermistor, and is in contact with the heating roller 52 (may also be contactless). The temperature sensor 55 has an output voltage value that changes depending on the temperature. The output of the temperature sensor 55 is inputted to the fixation control unit 50. The fixation control unit 50 recognizes the temperature of the heating roller 52 (the fixing unit 5) on the basis of the output of the temperature sensor 55. The fixation control unit 50 recognizes whether or not the heating roller 52 has arrived at a temperature that is suitable for heating and melting the toner (a fixation control temperature). The fixation control unit 50 adjusts the electric power being inputted to the heater so that the temperature of the heating roller 52 is kept at the fixation control temperature.

(The Load 9 Inside the Multifunction Peripheral 100)

Figure 5:
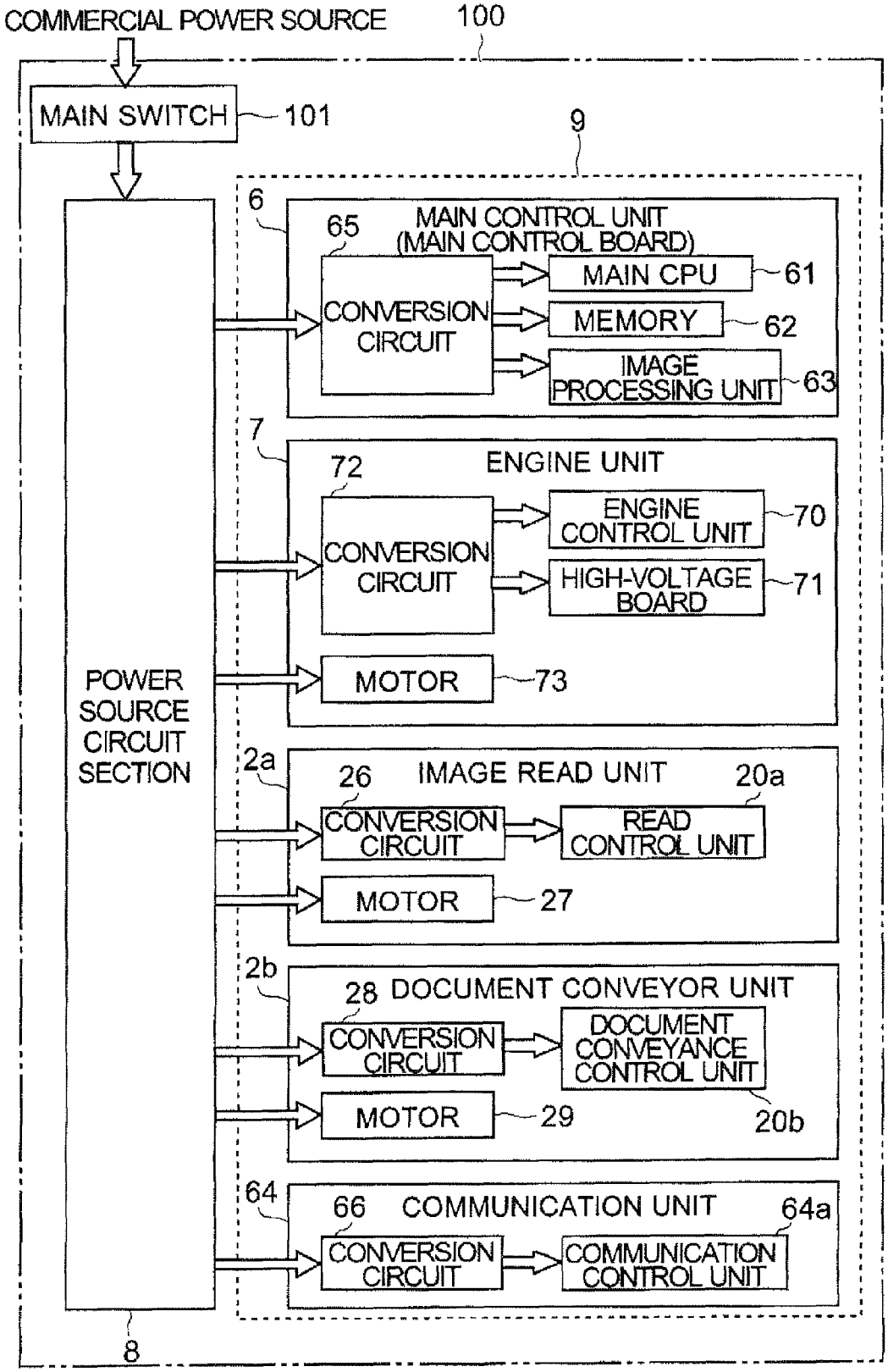
FIG. 5 is a block diagram illustrating one example of the loads inside a multifunction peripheral.

Described next is one example of the load 9 inside the multifunction peripheral 100 as in the first embodiment, with reference to FIG. 5. FIG. 5 is a block diagram illustrating one example of the load 9 inside the multifunction peripheral 100.

In the image-forming apparatus, the electric power consumed by the heater 51 of the fixing unit 5 accounts for a major proportion of the total electric power consumed. For example, when the total electric power consumed by the multifunction peripheral 100 is about 1,500 watts, then a heater 51 having a maximum output of about 1,000 to 1,200 watts is installed in the multifunction peripheral 100.

An electrical load 9 other than the fixation relationship is also installed in the multifunction peripheral 100. The load 9 refers to, for example, a variety of portions that include the main control unit 6, the engine unit 7, the image read unit 2*a*, the document conveyor unit 2*b*, the communication unit 64, and the like, as illustrated in FIG. 5. Other loads can be included in the load 9; not merely those depicted in FIG. 5; for example, though not depicted in FIG. 5, the fixation control unit 50 and the operation panel 2*c* are also included in the load 9.

Circuitry, such as the main CPU 61, the memory 62 and the image processing unit 63 (for example, an application-specific integrated circuit (ASIC)), is provided to the main control unit 6, as illustrated in FIG. 5. There may also be provided a conversion circuit 65 for generating a drive voltage for circuitry such as the main CPU 61, the memory 62, and the image processing unit 63, from the voltage supplied to the main control unit 6 from the power source circuit section 8 (for example, a DC/DC converter or a regulator; the same also applies to other conversion circuitry hereinbelow). The conversion circuit 65 need not be provided; rather all of the voltage needed by the main control unit 6 for driving may be generated in the power source circuit section 8 and supplied to the main control unit 6. The main CPU 61, the memory 62, the image processing unit 63, the conversion circuit 65, and the like also serve as the load 9.

The engine control unit 70 is also provided to the engine unit 7 for carrying out printing, as illustrated in FIG. 5. For example, the engine control unit 70 includes circuitry such as an engine CPU, a memory, and an ASIC. Also provided is a high-voltage board 71 for stepping up the voltage in order to develop the toner image in the image formation unit 4 and to transfer the toner image to the paper, and for generating voltage for developing and for transfer. There may also be provided a conversion circuit 72 for generating a drive voltage for the circuitry inside the engine control unit 70 and/or for the high-voltage board 71, from the voltage supplied to the main control unit 6 from the power source circuit section 8. The voltage needed by the engine unit 7 to drive may also be generated in the power source circuit section 8 and supplied to the engine unit 7. Furthermore, a plurality of motors 73 for rotating the rotating bodies for feeding the paper, conveying the paper, and forming the toner image are provided to the engine unit 7 (for the sake of convenience, only one motor 73 is depicted in FIG. 5). The engine control unit 70, the high-voltage board 71, the conversion circuit 72, the motors 73, and the like also serve as the load 9.

Also, as illustrated in FIG. 5, a read control unit 20*a* for controlling the reading of the document is provided to the image read unit 2*a*. For example, the read control unit 20*a* includes circuitry such as a CPU, a memory, and an ASIC for image processing. Circuitry such as an image sensor is also included in the image read unit 2*a*. There may also be provided a conversion circuit 26 for generating a drive voltage for the circuitry inside the read control unit 20*a* and/or for the image sensor, from the voltage supplied to the image read unit 2*a* from the power source circuit section 8. The voltage needed by the image read unit 2*a* to drive may also be generated in the power source circuit section 8 and supplied to the image read unit 2*a*. A motor for moving a lamp, mirror, or the like is also provided to the image read unit 2*a*. The image read unit 20*a*, the motor 27, and the like also serve as the load 9.

A document conveyance control unit 20*b* for controlling the conveyance of the document is also provided to the document conveyor unit 2*b*, as illustrated in FIG. 5. For example, the document conveyance control unit 20*b* includes circuitry such as a CPU and memory. There may also be provided a conversion circuit 28 for generating a drive voltage for the circuitry inside the document conveyance control unit 20*b*, from the voltage supplied to the document conveyor unit 2*b* from the power source circuit section 8. The voltage needed by the document conveyor unit 2*b* to drive may also be generated in the power source circuit section 8 and supplied to the document conveyor unit 2*b*. Furthermore, a motor 29 for rotating a roller for conveying the document is provided to the document conveyor unit 2*b*. The document conveyance control unit 20*b*, the motor 29, and the like also serve as the load 9.

Additionally, a communication control unit 64*a* for controlling communication is provided to the communication unit 64, as illustrated in FIG. 5. For example, the communication control unit 64*a* includes circuitry such as a CPU, a memory, and a driver integrated circuit (IC). There may also be provided a conversion circuit 66 for generating a drive voltage for the circuitry of the communication unit 64, from the voltage supplied to the communication unit 64 from the power source circuit section 8. The voltage needed by the communication unit 64 to drive may also be generated in the power source circuit section 8 and supplied to the communication unit 64.

(Changes in the Power Factor of the Fixing Unit 5 Due to Phase Changes in Phase Control)

Figure 6:
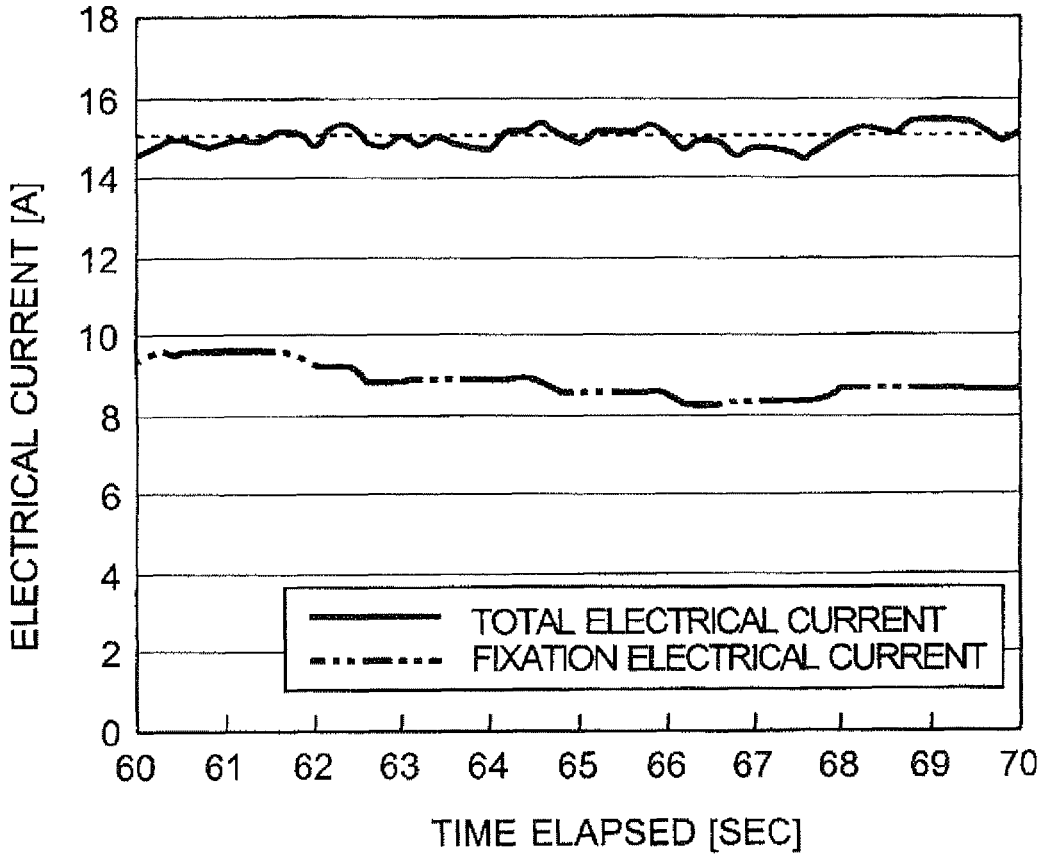
FIG. 6 is a graph illustrating one example of the transitions in the total electrical current of a conventional image-forming apparatus, with respect to changes in the fixation electrical current.

Described next is the influence of phase changes in phase control on the fixing unit 5 in the multifunction peripheral 100 as in the first embodiment, with reference to FIG. 6. FIG. 6 is a graph illustrating one example of the transitions in the total electrical current of a conventional image-forming apparatus, with respect to changes in the fixation electrical current.

In order to warm the fixing unit 5 as promptly as possible and reduce the wait time for the user, the electric power inputted to the heater 51 should be increased. However, this does not imply that limitless electric power can be inputted to the heater 51. There are limitations to the magnitude of electrical current (effective value) that can flow with the commercial power source (the magnitude of electrical current that can flow in electric power distribution equipment such as an outlet). Though varying from country to country and from standard to standard, the electrical current that can flow in one outlet is often, for example, about 15 A to 20 A in the U.S.A. and Japan.

For this reason, the total electrical current of the multifunction peripheral 100 must, even when at a maximum, fall within a target value (for example 15 A). Also, in the multifunction peripheral 100 of the present embodiment, so as to successfully avoid destabilizing the operation and processing by the variety of control units and avoid giving rise to a defect in the rotational control of the motors, it is the electrical current to the fixing unit 5 (the heater 51), and not that to the load 9, that is increased or reduced to bring the total electrical current of the multifunction peripheral 100 within the target value. In the following description of the present embodiment, the target value is described as being 15 A (effective value), in consideration of the limiting values (regulated value, upper limit value) in the use of the commercial electric power supply, but the target value is not limited to being 15 A, and may be 15 A or below.

As described above, delaying the phase until when the supply of electric power to the heater 51 of the fixing unit 5 is started (creating a time lag from the zero-crossing point until the start of electric power distribution) with respect to the waveform (sine wave) of the voltage being applied to the heater 51 (lowering the duty) leads to a corresponding decrease in the magnitude (effective value) of the electrical current flowing to the fixing unit 5. However, delaying the phase at which the heater 51 of the fixing unit 5 starts to be energized leads to the electrical current first flowing to the fixing unit 5 at a correspondingly delayed phase in comparison to the voltage (leads to a correspondingly greater deviation between the voltage and electrical current). As such, delaying the phase at which the heater 51 of the fixing unit 5 starts to be energized leads to a corresponding worsening of the power factor of the fixing unit 5.

The ratio of the amount of change in the total electrical current of the multifunction peripheral 100 relative to the amount of change in the phase at which the heater 51 of the fixing unit 5 starts to be energized (the amount of change in the fixation electrical current) changes depending on the power factor of the fixing unit 5 (the status of the fixing unit 5 prior to phase change) and the combined value of the power factors of the fixing unit 5 and the power source circuit section 8. In light of these reasons, when the power factor of the fixing unit 5 is different, the amount of change in the total electrical current of the multifunction peripheral 100 (the amount of change in the fixation electrical current) will not be the same, even though the amount of change in the phase at which the heater 51 of the fixing unit 5 starts to be energized is the same.

It is not preferable for the total electrical current of the image-forming apparatus to persistently be greater than the upper limit In view whereof, in some conventional cases, the magnitude (for example, the effective value) of the total electrical current of the image-forming apparatus is measured by an electrical current sensor or the like. A control by which the electrical current flowing to the heater (the fixing unit) is adjusted (feedback control) is sometimes also carried out on the basis of the measured total electrical current so that the total electrical current of the image-forming apparatus falls within the target value. In the conventional image-forming apparatus, however, the amount of change in the phase at which the heater starts to be energized (the amount of change in the duty ratio) is established in a fixed fashion relative to the amount of total electrical current that is to be increased or reduced, irrespective of the prevailing power factor of the fixing unit. For this reason, the feedback control has not been able to rapidly match the total electrical current of the image-forming apparatus to the target value with a small number of iterations of adjusting the fixation electrical current. If fewer than ten iterations of feedback (correction) for altering the phase at which the heater starts to be energized are carried out, the difference between the total electrical current and the target value is sometimes not substantially eliminated.

Moreover, the load electrical current changes depending on the operating status of the image-forming apparatus. For example, when printing as a printer is implemented on the basis of received image data, because the image read unit 2*a* and the document conveyor unit 2*b* are not used, less of a load electrical current is used, in comparison to when a copy job is executed. Portions for carrying out printing need not be used during use of the scan functionality or during image data transmission such as for fax transmissions.

For this reason, the maximum value of the fixation electrical current that is acceptable while the total electrical current of the image-forming apparatus is being kept to the target value changes depending on the status of the image-forming apparatus (the process being executed). For example, in consideration of the magnitude of the load electrical current, between a copy job execution time and a standby time, it is the standby time that will have a greater acceptable maximum value of the fixation electrical current.

In view whereof, FIG. 6 illustrates one example of the changes in the fixation electrical current relative to the changes in the total electrical current in a conventional image-forming apparatus. The graph in FIG. 6 illustrates an example where the target value of the total electrical current is set to be 15 A.

As described above, the total electrical current is influenced by the results of combining the power factor of the power source circuit section (for example, a power factor of about 0.6) and the power factor of the fixing unit. For this reason, the total electrical current does not necessarily change to the same extent as the change in the fixation electrical current. In light of such reasons, it is difficult for the conventional feedback control to rapidly match the total electrical current of the image-forming apparatus to the target value with a small number of iterations of adjusting the fixation electrical current. Furthermore, the electrical current flowing to the load changes depending on the status of the image-forming apparatus, and the maximum acceptable value of the fixation electrical current changes depending on the processing (operating state) being executed by the image-forming apparatus. For this reason, as illustrated by the graph in FIG. 6, the total electrical current is continually either above or below the target value. As also illustrated in FIG. 6, the fact that the fixation electrical current gradually falls from about 9.5 A to 8 A does not imply that the total electrical current will fall by the same extent.

In view whereof, in the present embodiment, electrical current change amount data establishing the amount of change in the magnitude of the total electrical current relative to the amount of change in the phase at which the fixing unit 5 (the heater 51) starts to be energized for each value of the power factor of the fixing unit 5 in accordance with the status of the image-forming apparatus is stored in the memory 502 (may also be stored in another storage device, such as the memory 62 or the memory of the engine control unit 70). The phase at which the heater 51 starts to be energized is altered in accordance with the prevailing power factor of the fixing unit 5, using the electrical current change amount data, so that the total electrical current of the multifunction peripheral 100 flowing to the load 9 rapidly reaches the target value. This makes it possible to cause the greatest possible fixation electrical current to flow, while also keeping the total electrical current of the multifunction peripheral 100 at the target value, and also possible to curb the time needed to warm up the fixing unit 5.

(The Electrical Current Change Amount Data)

Described next is one example of the electrical current change amount data as in the first embodiment, with reference to FIG. 7. FIG. 7 is a descriptive diagram illustrating one example of the electrical current change amount data as in the first embodiment.

The electrical current flowing to the load 9 and the power factor of the load portion, including the power source circuit section 8, change in accordance with the state of the multifunction peripheral 100. When the phase at which the fixing unit 5 (the heater 51) starts to be energized is altered, the amount of change in the total electrical current of the multifunction peripheral 100 is influenced not only by the change in the power factor of the fixing unit 5, but also the power factor of the load 9. In other words, when the phase at which the fixing unit 5 (the heater 51) starts to be energized is altered, the amount of change in the total electrical current of the multifunction peripheral 100 is influenced by a value obtained by combining the power factors of the fixing unit 5 and the load 9. In view whereof, in the present embodiment, data (electrical current change amount data) establishing the amount of change in the magnitude of the total electrical current relative to the amount of change in the phase at which the fixing unit 5 (the heater 51) starts to be energized for each value of the power factor of the fixing unit 5 is stored in the memory 502 or the like. The electrical current change amount data is allocated in accordance with the state of the multifunction peripheral 100 (the process being executed).

A variety of states of the multifunction peripheral 100 (processes being executed) exist. When consideration must be given to preventing the total electrical current of the multifunction peripheral 100 from exceeding a limit (the target value) is when electric power is to be supplied to the heater 51 of the fixing unit 5. In other words, some of the total electrical current of the multifunction peripheral 100 relative to the target value will not be used when there is no need to warm the fixing unit 5, or when electric power is not supplied to the heater 51 such as in a job where the fixing unit 5 is not used.

In view whereof, as illustrated in FIG. 7, turning on the main switch 101 places the multifunction peripheral 100 in a state available for use, and therefore a warm-up execution state for warming the cooled fixing unit 5 to the fixation control temperature and a copy job execution state or printer job execution state in which the fixing unit is warmed for the purpose of printing can be understood to be one class of state defined by the electrical current change amount data (allocated in terms of the process being executed). The portion of the load 9 that is to be used is determined by the state of the multifunction peripheral 100 (by the process being executed), and thus the electrical current that flows to the load 9 falls within a certain range for every state of the multifunction peripheral 100.

In the electrical current change amount data, allocation is made for each of the states of the multifunction peripheral 100 (processes being executed), and the amount of change in the total electrical current relative to the amount of change in the phase at which the heater 51 starts to be energized is determined in accordance with the power factor of the fixing unit 5 in each of the cases. In FIG. 7, the power factor is illustrated by the variable X, and the amount of change in the total electrical current is illustrated by the variable Y. The power factor of the fixing unit 5 can be established in increments of, for example, 0.01 or 0.05.

The amount of change in the phase could also be illustrated using an angle, such as in radians, but in FIG. 7 the amount of change in the phase is illustrated as the amount of change in the proportion for distributing electric power to the heater 51 per one period (percentage; ON duty). With the amount of change in the phase, the electrical current change amount data can be established in increments of, for example, 1% or 5%.

The fixation control unit 50 consults the electrical current change amount data and, on the basis of the present state (power factor) of the fixing unit 5 and the state of the multifunction peripheral (processing or job being executed), the fixation control unit 50 is capable of knowing in advance the extent to which the total electrical current of the multifunction peripheral 100 will change when the phase at which the fixing unit 5 (the heater 51) starts to be energized is altered to a given extent.

The fixation control unit 50 uses for the electrical current change amount data the result of taking measurements of the amount of change in the magnitude (effective value) of the total electrical current when the phase is altered in actuality, on the basis of the output of the total electrical current sensor S1. For example, measurement may be carried out during production and shipment, the electrical current change amount data then being stored as predetermined data in the memory 502 or the like.

Alternatively, the fixation control unit 50 may carry on sequentially accumulating in the memory 502 the results of measuring the amount of change in the total electrical current when the phase was altered in actuality, in accordance with the power factor of the fixing unit 5 during each of the states (jobs being executed); then, the use of the multifunction peripheral 100 allows the fixation control unit 50 or the memory 502 to carry on sequentially generating and updating the electrical current change amount data.

Alternatively, the multifunction peripheral 100 may be endowed with a mode for creating electrical current change amount data, in order to take measurements. In this case, when the mode for creating the electrical current change amount data is selected on the operation panel 2*c*, the fixation control unit 50 generates the electrical current change amount data on the basis of the result of measuring the amount of change in the magnitude (effective value) of the total electrical current when the phase was altered in actuality, and stores the electrical current change amount data in the memory 502. In the multifunction peripheral 100, the portion of the load 9 to be used from among the entirety of the load 9 is determined depending on the respective state (process being executed). In view whereof, standards for the magnitude of the electrical current flowing to the load 9 are predetermined, allocated for every state. Then, in the mode for creating the electrical current change amount data, the standards of the electrical current that flows to the load 9 (the power source circuit section 8) may be predetermined for every state of the multifunction peripheral 100, the measurement then being carried out with the main control unit 6 and/or the engine control unit 70 causing an electrical current as per the standard to flow to the load 9 being used in the measured state. This makes it possible to obtain highly accurate electrical current change amount data without the need to actually execute jobs.

(Electrical Current Control Using the Electrical Current Change Amount Data)

Figure 8:
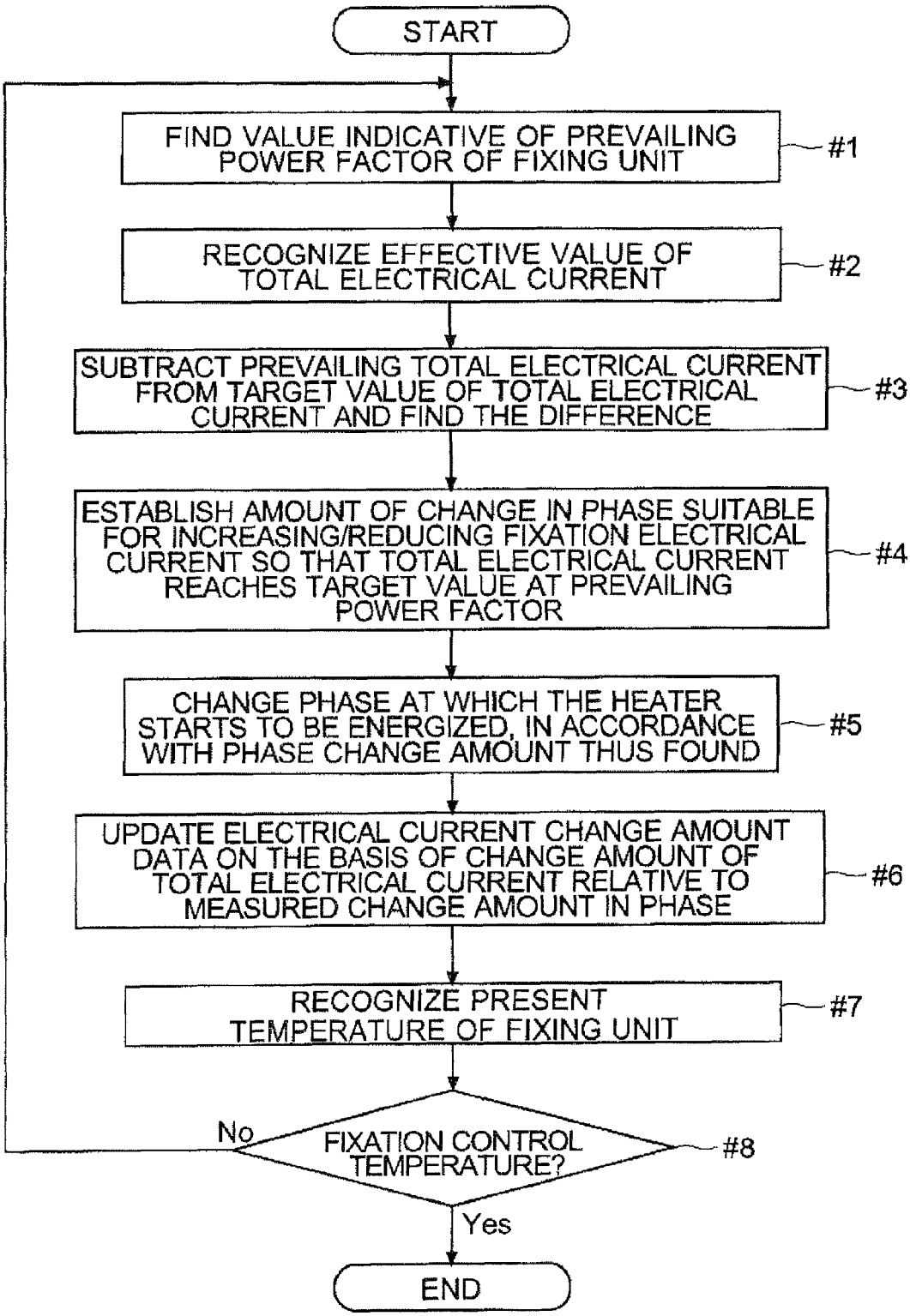
FIG. 8 is a flow chart illustrating one example of electrical current control using the electrical current change amount data in the multifunction peripheral as in the first embodiment.

Described next is one example of the flow for electrical current control using the electrical current change amount data in the multifunction peripheral 100 as in the first embodiment, with reference to FIG. 8. FIG. 8 is a flow chart illustrating one example of the electrical current control using the electrical current change amount data in the multifunction peripheral 100 as in the first embodiment.

For example, START in FIG. 8 is a point in time for using the electrical current change amount data and carrying out a control for causing the greatest possible electrical current to flow to the heater 51 of the fixing unit 5 to rapidly warm the heating roller 52. For example, the START time is when warm-up is being executed in association with the turning on of the main power source, when the fixing unit 5 has been cooled when there has been an instruction to execute a print job, when the temperature of the fixing unit 5 has dropped as a result of printing having been carried out continuously for a plurality of pages, and the like. When the heating roller 52 (the fixing unit 5) arrives at a fixation control temperature that is proper in terms of heating and fusing the toner, then during an interval where [the heating roller] must be maintained at the fixation control temperature (for example, during printing or during standby), the fixation control unit 50, for example, carries out the phase control (carries out the output adjustment for the heater 51) to keep the temperature of the heating roller 52 at the fixation control temperature.

The fixation control unit 50 recognizes the effective value of the electrical current flowing to the fixing unit 5, on the basis of the output of the fixation electrical current sensor S2, and finds a value indicative of the prevailing power factor of the fixing unit 5 (step #1). For example, the fixation control unit 50 uses the following calculating formula to find the value indicative of the prevailing power factor of the fixing unit 5.

Power factor=fixing electrical current/(present phase (duty)×rated electric power(rated output) of the heater/input voltage) (Calculating formula)

The fixation electrical current and the input value are effective values. For example, when the fixing electrical current is 10 A, the duty is 100%, the rated electric power of the heater is 1,000 W, and the input AC is 100 V, then the power factor is 1. The power factor of the electrical current change amount data, too, corresponds to the value found by the above-given calculating formula.

The fixation control unit 50 is able to recognize the magnitude of the fixation electrical current on the basis of the fixation electrical current sensor S2. The fixation control unit 50 also recognizes the present phase angle (the proportion of one period where the heater 51 is turned on) in order to control the drive circuit 54. The input voltage of the commercial power source is inputted to the fixation control unit 50, and the input voltage is recognized by a CPU or the like. The rated voltage of the heater 51 is predetermined. The multifunction peripheral 100 uses an A/C voltage (input voltage of the commercial power source) that is pre-determined for every destination in order to be used and supplied worldwide in exportation, overseas production, and the like (for example, this is AC 120 V in the U.S.A., AC 100 V in Japan, 220, 230, or 240 V in Europe, and so forth).

The fixation control unit 50 recognizes the effective value of the total electrical current of the multifunction peripheral 100 on the basis of the output of the total electrical current sensor S1 (step #2). The fixation control unit 50 subtracts the prevailing total electrical current from the target value (an effective value; for example, 15 A) of the total electrical current of the multifunction peripheral 100, and finds the difference (step #3).

Furthermore, the fixation control unit 50 consults the electrical current change amount data and establishes the amount of change in phase in the fixing unit 5 that is needed in terms of altering the total electrical current so as to be able to make the difference thus found become zero, in accordance with the prevailing power factor of the fixing unit 5 (step #4). In other words, the fixation control unit 50 establishes the amount of change in the phase (the duty ratio after change) at which the fixation electrical current can be increased or reduced so that the total electrical current reaches the target value, within the prevailing power factor (step #4). For example, when the prevailing total electrical current is greater than the target value, the fixation control unit 50 establishes an amount of change in the phase for reducing the fixation electrical current to an extent commensurate with the difference. When the prevailing total electrical current is less than the target value, the fixation control unit 50 establishes an amount of change in the phase whereby the fixation electrical current is increased to an extent commensurate with the difference. More specifically, when the prevailing total electrical current is greater than the target value by 1 A, the fixation control unit 50 consults the electrical current change amount data to establish an amount of change in the phase whereby the fixation electrical current is reduced by 1 A in the prevailing power factor. The fixation control unit 50 considers the power factor from when the fixation electrical current was increased or reduced, and controls the control duty of fixation so that the total electrical current reaches the target value.

The fixation control unit 50 controls the drive circuit 54 and alters the phase at which the heater 51 starts to be energized in accordance with the amount of change in the phase thus found (step #5). The fixation control unit 50 then recognizes (measures) the amount of change in the total electrical current relative to the amount of change in the phase, in the state where the fixing unit 5 is at the power factor thus found, and updates the electrical current change amount data in the memory 502 on the basis of the recognized amount of change in the total electrical current (step #6). More specifically, the memory 502 updates the value (the amount of change in the total electrical current) of the portion within the electrical current change amount data that matches the conditions at which the amount of change in the total electrical current was measured, in accordance with the allocation to the prevailing process being executed (warm-up, copying, or the like) and with the power factor of the fixing unit 5 (see FIG. 7).

Next, the fixation control unit 50 recognizes the present temperature of the heating roller 52 (the fixing unit 5) on the basis of the output of the temperature sensor 55 (step #7). The fixation control unit 50 recognizes whether or not the temperature of the heating roller 52 (the fixing unit 5) has arrived at a fixation control temperature that is proper in terms of melting and fixing the toner (step #8).

In the event that the temperature of the heating roller has arrived at the fixation control temperature ("Yes" in step #8), the fixing unit 5 has been successfully and adequately warmed, and thus the present control should be terminated (END). However, in the event that the temperature of the heating roller has not arrived at the fixation control temperature ("No" in step #8), then the fixing unit 5 still must be warmed, and thus the flow returns to step #1.

The image-forming apparatus (multifunction peripheral 100) as in the first embodiment thus includes: the fixing unit 5 for fixing the toner image onto the paper using the heat generator (heater 51) receiving the electric power supplied to the image-forming apparatus and generating heat; the load 9 used in the execution of a job; the power source circuit section 8 for generating voltage for the load 9 on the basis of the electric power supplied to the image-forming apparatus and for supplying electric power to the load 9; the fixation electrical current detecting body (the fixation electrical current sensor S2) for detecting the magnitude of the fixation electrical current, which is the electrical current that flows to the fixing unit 5; the total electrical current detecting body (the total electrical current sensor S1) for detecting the magnitude of the total electrical current of the image-forming apparatus, obtained by the sum of the electrical current flowing to the fixing unit 5 and the electrical current flowing to the load 9; the storage unit (the memory 502) for storing the electrical current change amount data establishing the amount of change in the magnitude of the total electrical current relative to the amount of change in the phase at which the heat generator starts to be energized, for each value of the power factor of the fixing unit 5; and the fixation control unit 50 for controlling the drive circuit 54 for supplying and shutting off electric power to the heat generator, carrying out the phase control for altering the phase for turning on the distribution of electric power during the period of the voltage being applied to the heat generator, recognizing the magnitude of the fixation electrical current on the basis of the output of the fixation electrical current detecting body and finding the power factor of the fixing unit 5, recognizing the magnitude of the total electrical current on the basis of the output of the total electrical current detecting body, and controlling the drive circuit 54 and altering the phase at which the heat generator starts to be energized on the basis of the value indicative of the power factor thus found, the state of the image-forming apparatus, and the electrical current change amount data, so that the total electrical current approaches the target value.

This makes it possible to carry out a rapid feedback control so that the total electrical current of the image-forming apparatus (the multifunction peripheral 100) reaches the target value, while also giving consideration to the power factor of the fixing unit 5 associated with the change in the phase for turning on energization in the phase control. As such, the electrical current can be controlled in real-time. Yet, with the magnitude of the electrical current flowing to the load 9 varying in accordance with the state of the image-forming apparatus, it is also possible to correct the magnitude of the fixing unit 5 in accordance with the state of the image-forming apparatus so that the total electrical current reaches the target value. As such, the output of the heater can be rapidly matched to the maximum output in the acceptable range, irrespective of the state of the image-forming apparatus, and the speed at which the temperature of the fixing unit 5 is elevated can be maximized in accordance with the circumstances. Also, because the storage unit (the memory 502) stores the electrical current change amount data establishing the amount of change in the magnitude of the total electrical current relative to the amount of change in the phase at which the heat generator (the heater 51) starts to be energized for each value of the power factor of the fixing unit 5, it is possible to rapidly match the output of the heater to the maximum output in the acceptable range while also addressing the individual differences that exist between image-forming apparatuses in terms of the magnitude of electrical current consumed by the motors and control boards.

The storage unit (the memory 502) stores the electrical current change amount data establishing the amount of change in the magnitude of the total electrical current relative to the amount of change in the phase at which the heat generator (the heater 51) starts to be energized, for each value of the power factor of the fixing unit 5, allocated in accordance with the process executed by the image-forming apparatus (the multifunction peripheral 100), and the fixation control unit 50 controls the drive circuit 54 to alter the phase at which the heat generator starts to be energized, on the basis of the value indicative of the power factor thus found, the process performed by the image-forming apparatus, and the electrical current change amount data, so that the total electrical current approaches the target value. With the magnitude of the electrical current that flows to the load 9 varying in accordance with the process executed by the image-forming apparatus (the operating state thereof), it is possible to correct the magnitude of the electrical current of the fixing unit 5 in accordance with the process executed by the image-forming apparatus so that the total electrical current approaches the target value. As such, the output of the heater can be rapidly matched to the maximum output in the acceptable range, irrespective of the process being executed by the image-forming apparatus, and the speed at which the temperature of the fixing unit 5 is elevated can be maximized in accordance with the circumstances.

The fixation control unit 50 controls the drive circuit 54 to alter the phase at which the heat generator (the heater 51) starts to be energized, in accordance with the prevailing power factor of the fixing unit 5, so that the total electrical current is increased or reduced commensurate with the difference between the target value and the prevailing total electrical current. This makes it possible for the total electrical current of the image-forming apparatus (the multifunction peripheral 100) to become substantially the same as the target value, merely by carrying out one iteration of feedback control, and possible to make use of electric power to rapidly warm the fixing unit 5 in a range where consumption is acceptable.

The fixation control unit 50 finds the value indicative of the power factor of the fixing unit 5, and recognizes the amount of change in the total electrical current relative to the amount of change in the phase in the state of the power factor thus found, and the storage unit (the memory 502) updates the electrical current change amount data on the basis of the recognized amount of change in the total electrical current. This makes it possible, even after a change in the properties of the image-forming apparatus (the multifunction peripheral 100) due to the passage of time has taken place, for the electrical current change amount data to be data that has been adapted to the state of following the change in properties. As such, it is possible to uphold a state where there is no error in the feedback control for correcting the phase control so that the total electrical current of the image-forming apparatus reaches the target value.

The target value is a limiting value that serves as an upper limit of the rated electrical current in regard to the use of the commercial power source. This makes it possible to input the maximum electrical current to the heater within the acceptable range, while also maintaining the electric power that must be supplied to the load 9 (the electrical current that flows to the load 9), without imparting a margin to the target value. Because the magnitude of the electrical current does not exceed the limiting value in the use of the commercial power source, it is possible to use the image-forming apparatus (the multifunction peripheral 100) safely while complying with regulations.

(Second Embodiment)

Figure 9:
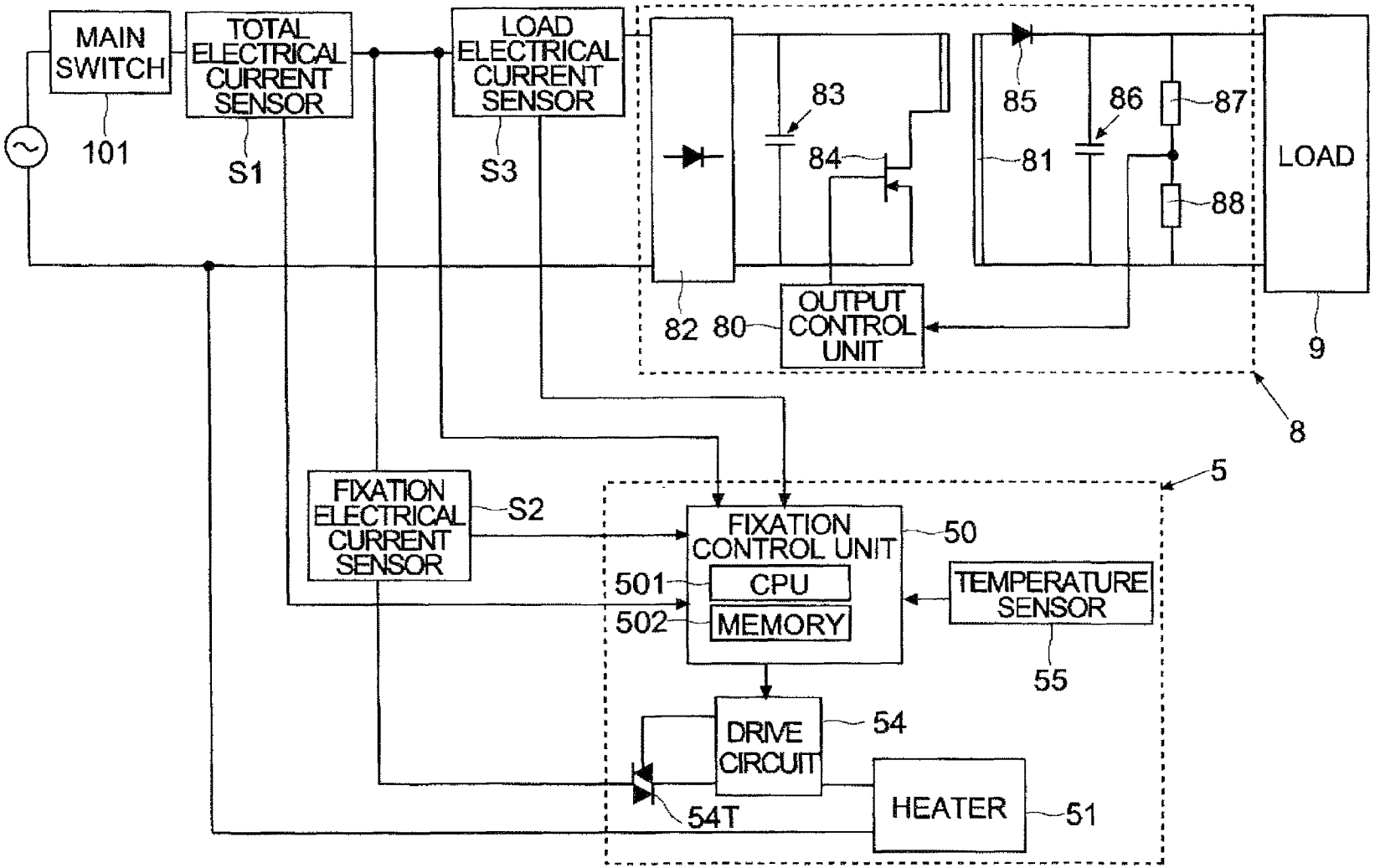
FIG. 9 is a descriptive diagram illustrating one example of a electric power supply system in a multifunction peripheral as in a second embodiment.

Described next is the multifunction peripheral 100 as in the second embodiment, with reference to FIGS. 9 and 10. FIG. 9 is a descriptive diagram illustrating one example of a electric power supply system in the multifunction peripheral 100 as in the second embodiment. FIG. 10 is a descriptive diagram illustrating one example of the electrical charge change amount data as in the second embodiment.

Firstly, the second embodiment provides the image-forming apparatus of the first embodiment (the multifunction peripheral 100) with a load electrical current detecting body for detecting the magnitude of the electrical current flowing to the load 9 (a load electrical current). A point of difference is that the electrical current change amount data is established not in accordance with the operating state of the image-forming apparatus, but rather in accordance with the magnitude of the load electrical current. The second embodiment is in other regards similar with respect to the first embodiment, and descriptions or depictions of portions in common with the first embodiment have been omitted with the exception of cases being specifically described.

As illustrated in FIG. 9, a load electrical current sensor S3 (equivalent to a load electrical current detecting body) is provided to the power source circuit section 8. The load electrical current sensor S3 is a sensor for measuring the magnitude of the electrical current that flows to the load 9 via the power source circuit section 8. The output of the load electrical current sensor S3 is inputted to the fixation control unit 50. The fixation control unit 50 measures and recognizes the magnitude (effective value) of the electrical current that flows to the load 9 of the image-forming apparatus, on the basis of the output of the load electrical current sensor S3.

The electrical current that flows to the load 9 and the power factor of the load portion change depending on the state of the multifunction peripheral 100. When the phase at which the fixing unit 5 (the heater 51) starts to be energized is altered, the amount of change in the total electrical current of the multifunction peripheral 100 is influenced by the change in the power factor of the fixing unit 5 (and is also influenced by the power factor of the load 9). In other words, when the phase at which the fixing unit 5 (the heater 51) starts to be energized is altered, the amount of change in the total electrical current of the multifunction peripheral 100 is influenced by a value obtained by combining the power factors of the fixing unit 5 and the load 9. In view whereof, in the present embodiment, data establishing the amount of change in the magnitude of the total electrical current relative to the amount of change in the phase at which the fixing unit 5 (the heater 51) starts to be energized for each value of the power factor of the fixing unit 5 in accordance with the electrical current flowing to the load 9, as the state of the multifunction peripheral 100, is stored in the memory 502 or the like.

The magnitude of the load electrical current changes depending on the state of operation of the multifunction peripheral 100. In the electrical current change amount data of the present embodiment, the amount of change in the total electrical current relative to the amount of change in the phase at which the heater 51 starts to be energized is established in accordance with the power factor of the fixing unit 5, allocated depending on the magnitude of the load electrical current (see FIG. 9). In FIG. 9, the power factor is illustrated by the variable X, and the amount of change in the total electrical current is illustrated by the variable Y. The magnitude of the load electrical current is illustrated by the variable Z.

For example, data establishing the amount of change in the total electrical current relative to the amount of change in the phase, in accordance with the power factor for every 0.1 A or 0.5 A of the load electrical current, is established as the electrical current change amount data. The approach to establishing the power factor of the fixing unit 5 and the approach to establishing the amount of change in the phase are similar with respect to the first embodiment.

The fixation control unit 50 uses for the electrical current change amount data the result of taking measurements of the amount of change in the magnitude (effective value) of the total electrical current when the phase is altered in actuality, on the basis of the output of the total electrical current sensor S1. For this reason, the fixation control unit 50 may carry on sequentially accumulating in the memory 502 the results of measuring the amount of change in the total electrical current when the phase was altered in actuality, in accordance with the power factor of the fixing unit 5, with respect to the magnitude of the load electrical current. In this case, the fixation control unit 50 recognizes (measures) the amount of change in the total electrical current relative to the amount of change in the phase, in the state where the fixing unit 5 is at the power factor thus found, and updates the electrical current change amount data in the memory 502 on the basis of the recognized amount of change in the total electrical current. More specifically, the memory 502 updates the value (the amount of change in the total electrical current) of the portion within the electrical current change amount data that matches the conditions at which the amount of change in the total electrical current was measured (matches the load electrical current value and the power factor of the fixing unit 5), in accordance with the allocation of the prevailing magnitude of the load electrical current and the power factor of the fixing unit 5 (see FIG. 9). The electrical current change amount data may thus be sequentially generated and continually updated through the usage of the multifunction peripheral 100.

Alternatively, the multifunction peripheral 100 may be endowed with a mode for creating the electrical current change amount data, in order to take measurements. In this case, when the mode for creating, the electrical current change amount data is selected on the operation panel 2*c*, the fixation control unit 50 generates the electrical current change amount data on the basis of the result of measuring the amount of change in the magnitude (effective value) of the total electrical current when the phase was altered in actuality, and stores the electrical current change amount data in the memory 502. For example, the fixation control unit 50 switches the electrical current flowing to the power source circuit section 8 and the load 9 to a fixed magnitude at every interval in the magnitude of the load electrical current, and every time in doing so, measures the amount of change in the total electrical current when the phase is altered in actuality, in accordance with the power factor of the fixing unit 5. The electrical current change amount data may then be generated on the basis of the measurement result therefrom.

Though the electrical current change amount data and electrical current values that are consulted (in the second embodiment, it is the load electrical current value that is consulted) are different, the flow for the electrical current control using the electrical current change amount data is fundamentally similar with respect to the first embodiment (see FIG. 8). For this reason, reference may be made to the description for the first embodiment.

Thus, the image-forming apparatus (the multifunction peripheral 100) as in the second embodiment includes the load electrical current detecting body (the load electrical current sensor S3) for detecting the magnitude of the load electrical current flowing to the load 9. The storage unit (the memory 502) stores the electrical current change amount data establishing the amount of change in the magnitude of the total electrical current relative to the amount of change in the phase at which the heat generator (the heater 51) starts to be energized for each value of the power factor of the fixing unit 5, allocated in accordance with the magnitude of the load electrical current serving as the state of the image-forming apparatus. The fixation control unit 50 recognizes the magnitude of the load electrical current on the basis of the output of the load electrical current detecting body, and controls the drive circuit 54 to alter the phase at which the heat generator starts to be energized, on the basis of the value indicative of the power factor thus found, the magnitude of the load electrical current, and the electrical current change amount data, so that the total electrical current approaches the target value. It is possible to correct the magnitude of the electrical current of the fixing unit 5 in accordance with the magnitude of the electrical current to the portions of the load 9 (the load electrical current), other than the heater, in the image-forming apparatus, so that the total electrical current approaches the target value. As such, it is also possible to rapidly match the output of the heater to the maximum output within the acceptable range, irrespective of the magnitude of the load electrical current of the image-forming apparatus, and also possible to maximize the speed at which the temperature of the fixing unit 5 is elevated, in accordance with the circumstances.

The fixation control unit 50 finds the value indicative of the power factor of the fixing unit 5, and recognizes the amount of change in the total electrical current relative to the amount of change in the phase in the state of the power factor thus found, and the storage unit (the memory 502) updates the electrical current change amount data on the basis of the recognized amount of change in the total electrical current. This makes it possible, even after a change in the properties of the image-forming apparatus (the multifunction peripheral 100) due to the passage of time has taken place, for the electrical current change amount data to be data that has been adapted to the state of following the change in properties. As such, it is possible to uphold a state where there is no error in the feedback control for correcting the phase control so that the total electrical current of the image-forming apparatus reaches the target value.

The present disclosure can also be regarded as being the disclosure of a method.

What is claimed is:

1. An image-forming apparatus, comprising:

a fixing unit for fixing a toner image onto paper, using a heat generator for generating heat upon receiving electric power supplied to the image-forming apparatus;

a load that is used in the execution of a job;

a power source circuit section for generating voltage for the load on the basis of the electric power supplied to the image-forming apparatus and supplying electric power to the load;

a fixation electrical current detecting body for detecting the magnitude of a fixation electrical current, which is an electrical current that flows to the fixing unit;

a total electrical current detecting body for detecting the magnitude of the total electrical current of the image-forming apparatus, the total electrical current being the sum of the electrical current that flows to the fixing unit and an electrical current that flows through the load;

a storage unit for storing electrical current change amount data establishing an amount of change in the magnitude of the total electrical current relative to an amount of change in a phase at which the heat generator starts to be energized, for each value of the power factor of the fixing unit; and a fixation control unit for: controlling a drive circuit for starting and stopping energizing of the heat generator, carrying out a phase control for altering the phase in which energizing in a period of voltage being applied to the heat generator is activated; recognizing the magnitude of the fixation electrical current on the basis of an output of the fixation electrical current detecting body and finding a value indicative of the power factor of the fixing unit; recognizing the magnitude of the total electrical current on the basis of an output of the total electrical current detecting body; and controlling the drive circuit to alter the phase at which the heat generator starts to be energized, on the basis of the value indicative of the power factor thus found, the state of the image-forming apparatus, and the electrical current change amount data, so that the total electrical current approaches a target value.

2. The image-forming apparatus as set forth in claim 1, wherein the storage unit stores the electrical current change amount data establishing the amount of change in the magnitude of the total electrical current relative to the amount of change in the phase at which the heat generator starts to be energized, for each value of the power factor of the fixing unit, allocated in accordance with the processing executed by the image-forming apparatus; and the fixation control unit controls the drive circuit to alter the phase at which the heat generator starts to be energized, on the basis of the value indicative of the power factor thus found, the process performed by the image-forming apparatus, and the electrical current change amount data, so that the total electrical current approaches a target value.

3. The image-forming apparatus as set forth in claim 2, wherein the fixation control unit finds a value indicative of the power factor of the fixing unit, and recognizes the amount of change in the total electrical current relative to the amount of change in the phase in the state of the power factor thus found, and the storage unit updates the electrical current change amount data on the basis of the recognized amount of change in the total electrical current.

4. The image-forming apparatus as set forth in claim 1, comprising:

a load electrical current detecting body for detecting the magnitude of a load electrical current, which flows to the load;

wherein the storage unit stores the electrical current change amount data establishing the amount of change in the magnitude of the total electrical current relative to the amount of change in the phase at which the heat generator starts to be energized for each value of the power factor of the fixing unit, allocated in accordance with the magnitude of the load electrical current serving as the state of the image-forming apparatus, and the fixation control unit recognizes the magnitude of the load electrical current on the basis of an output of the load electrical current detecting body, and controls the drive circuit to alter the phase at which the heat generator starts to be energized, on the basis of the value indicative of the power factor thus found, the magnitude of the load electrical current, and the electrical current change amount data, so that the total electrical current approaches a target value.

5. The image formation device as set forth in claim 4, wherein the fixation control unit finds a value indicative of the power factor of the fixing unit, and recognizes the amount of change in the total electrical current relative to the amount of change in the phase in the state of the power factor thus found, and the storage unit updates the electrical current change amount data on the basis of the recognized amount of change in the total electrical current.

6. The image-forming apparatus as set forth in claim 1, wherein the fixation control unit controls the drive circuit to alter the phase at which the heat generator starts to be energized, in accordance with the prevailing power factor of the fixing unit, so that the total electrical current is increased or reduced commensurately with the difference between the target value and the prevailing total electrical current.

7. The image-forming apparatus as set forth in claim 1, wherein the target value is a limit value serving as an upper limit of the rated electrical current in regard to use of a commercial power source.

8. A method for controlling an image-forming apparatus, comprising the following steps:

causing a toner image to be fixed onto paper by a fixing unit including a heat generator for generating heat upon receiving electric power supplied to the image-formation apparatus;

using a load in order to execute a job;

generating voltage for the load on the basis of the electric power supplied to the image-forming apparatus, and supplying the electric power to the load using the generated voltage;

detecting the magnitude of a fixation electrical current, which is an electrical current that flows to the fixing unit;

detecting the magnitude of the total electrical current of the image-forming apparatus, the total electric current being the sum of the electrical current that flows to the fixing unit and an electrical current that flows through the load;

storing electrical current change amount data establishing an amount of change in the magnitude of the total electrical current relative to an amount of change in a phase at which the heat generator starts to be energized, for each value of the power factor of the fixing unit;

finding a value indicative of the power factor of the fixing unit; and changing the phase at which the heat generator starts to be energized, on the basis of the value indicative of the power factor thus found, the state of the image-forming apparatus, and the electrical current change amount data, so that the total electrical current approaches a target value.

9. The method for controlling an image-forming apparatus as set forth in claim 8, further comprising:

storing the electrical current change amount data establishing the amount of change in the magnitude of the total electrical current relative to the amount of change in the phase at which the heat generator starts to be energized for each value of the power factor of the fixing unit, allocated in accordance with the process executed by the image-forming apparatus, and controlling a drive circuit to change the phase at which the heat generator starts to be energized on the basis of the value indicative of the power factor thus found, the state of the image-forming apparatus, and the electrical current change amount data, so that the total electrical current approaches the target value.

10. The method for controlling an image-forming apparatus as set forth in claim 9, further comprising:

finding the power factor of the fixing unit;

recognizing the amount of change in the total electrical current relative to an amount of change in the phase in the state of the power factor thus found; and updating the electrical current change amount data on the basis of the recognized amount of change in the total electrical current.

11. The method for controlling an image-forming apparatus as set forth in claim 8, further comprising:

detecting the magnitude of a load electrical current, which flows to the load;

storing the electrical current change amount data establishing the amount of change in the magnitude of the total electrical current relative to the amount of change in the phase at which the heat generator starts to be energized being stored for each value of the power factor of the fixing unit, allocated in accordance with the magnitude of the load electrical current; and controlling a drive circuit to change the phase at which the heat generator starts to be energized on the basis of the value indicative of the power factor thus found, the magnitude of the load electrical current, and the electrical current change amount data, so that the total electrical current approaches the target value.

12. The method for controlling an image-forming apparatus as set forth in claim 11, further comprising:

finding the power factor of the fixing unit;

recognizing the amount of change in the total electrical current relative to an amount of change in the phase in the state of the power factor thus found; and updating the electrical current change amount data on the basis of the recognized amount of change in the total electrical current.

13. The method for controlling an image-forming apparatus as set h in claim 8, further comprising:

controlling a drive circuit to change the phase at which the heat generator starts to be energized, in accordance with the prevailing power factor of the fixing unit, so that the total electrical current is increased or reduced commensurately with the difference between the target value and the prevailing total electrical current.

14. The method for controlling an image-forming apparatus as set forth in claim 8, further comprising:

the target value being a limiting value serving as an upper limit of the rated electrical current in regard to the use of a commercial power source.

* * * * *